US005122079A

United States Patent [19]

Locati

[11] Patent Number: 5,122,079

[45] Date of Patent: Jun. 16, 1992

[54] MULTIPLE CONDUCTOR CABLE CONNECTOR WITH TOWERS

[75] Inventor: Ronald P. Locati, Harrisburg, Pa.

[73] Assignee: AMP Incorporated, Harrisburg, Pa.

[21] Appl. No.: 690,018

[22] Filed: Apr. 23, 1991

[51] Int. Cl.[5] ..... H01R 4/24

[52] U.S. Cl. ..... 439/417

[58] Field of Search ..... 439/389–425

[56] References Cited

U.S. PATENT DOCUMENTS

| | | | |
|---|---|---|---|
| 4,068,912 | 1/1978 | Hudson, Jr. et al. | 339/99 R |
| 4,296,989 | 10/1981 | Larson et al. | 439/404 |
| 4,410,229 | 10/1983 | Stephenson | 339/98 |
| 4,412,714 | 11/1983 | Morningstar et al. | 339/91 R |
| 4,475,786 | 10/1984 | Root et al. | 439/404 |
| 4,496,207 | 1/1985 | Ensminger | 439/404 |
| 4,640,562 | 2/1987 | Shoemaker | 339/17 F |
| 4,668,039 | 5/1987 | Marzili | 339/99 R |
| 4,691,977 | 9/1987 | Marzili et al. | 439/404 |
| 4,693,533 | 9/1987 | Szczesny et al. | 439/350 |
| 4,902,243 | 2/1990 | Davis | 439/405 |

OTHER PUBLICATIONS

"Electronic Components"; Suyin Corp.; Apr. 1991.

*Primary Examiner*—Joseph H. McGlynn

[57] ABSTRACT

A multiple conductor cable connector (1) comprising a termination cover (4) and a housing (2). The termination cover (4) includes arms (19) at opposite ends thereof projecting substantially perpendicular to a cable engaging face (18). The housing (2) includes a cable receiving face (5) and towers (8) projecting from opposite ends of the housing (2) substantially perpendicular to the cable receiving face (5). Each tower (8) has a bulk section (9) with a latching surface (12) cooperable with latching means of the corresponding arm (19) for defining a pre-termination position and for securing the termination cover (4) to the housing (2) in the pre-termination position. Each tower (8) further includes an engaging ramp (16) and each arm (19) has an engaging ramp (26). The engaging ramps (16, 26) are biased against each other to further define the pre-termination position.

5 Claims, 9 Drawing Sheets

MULTIPLE CONDUCTOR CABLE CONNECTOR WITH TOWERS

FIELD OF THE INVENTION

The invention relates to a connector for insulation displacement termination of multiple conductor cable and, more particularly, to use of features of the connector which stabilize and secure the termination cover and connector housing using specially adapted towers on the housing and provides a rigid structure unaffected by normal handling.

BACKGROUND OF THE INVENTION

Electrical connectors for multiple conductor cables are well known in the art. However, as smaller connectors were demanded for a variety of applications, problems began to arise. Specifically, the connector had to be small enough to fit into the application. When two connectors are mated, their mating faces must fit exactly. Even though the size of a multiple conductor cable connector's mating face may be limited by the size of the mating face of a mating connector, for example, a connector attached to a circuit board, the cable receiving face of the connector must still be large enough to accommodate a cable, regardless of the dimensions of the connector's mating face. Not only might the surface area of the mating face be limited by the application, but a minimum height of the connector housing which must retain the limited cross sectional area may be required.

In addition, the reduced size connectors had difficulty with stability. The smaller parts were less able to maintain a termination cover and a housing in rigid position. Additionally, smaller connectors with small parts were more fragile. Plastic or other insulating material did not always have the strength to survive normal handling.

Co-pending U.S. patent application Ser. No. 07/613,348, herein incorporated by reference, discloses a multiple conductor cable connector, including a metallic clip which latches a termination cover and a housing. A projecting tab, a latch, and concave inner surfaces of the clip grasp a handle of the termination cover to secure it to the clip. The termination cover is recessed to allow the clip tab to fit flush with a rear surface of the termination cover. Convex outer surfaces of sleeves of the clip cooperate with concave inner surfaces of channels of opposed paired towers on the housing to guide the termination cover towards the housing. Use of the clip within the channels provides a rigid structure for the connector, unaffected by normal handling. Inner surfaces of the channels have protrusions which cooperate with leading edges on the clip to define a stop, and a cutout protrusion on the clip cooperates with a recess and shoulder in the channel inner surface; together these features define a pre-termination position. A separate protrusion on the housing body cooperates with a separate recess on the clip to define a termination position and to latch the termination cover to the housing.

SUMMARY OF THE INVENTION

In accordance with the present invention, a multiple conductor cable connector comprises a termination cover and a housing. The termination cover includes arms at opposite ends thereof projecting perpendicular to a cable engaging face. The housing includes a cable receiving face and towers projecting from opposite ends of the housing perpendicular to the cable receiving face. Each tower has a bulk section with latching means cooperable with latching means of the corresponding arm for defining a pre-termination position and for securing the termination cover to the housing in the pre-termination position.

DETAILED DESCRIPTION OF THE PREFERRED EMBODIMENT

Figure 1:
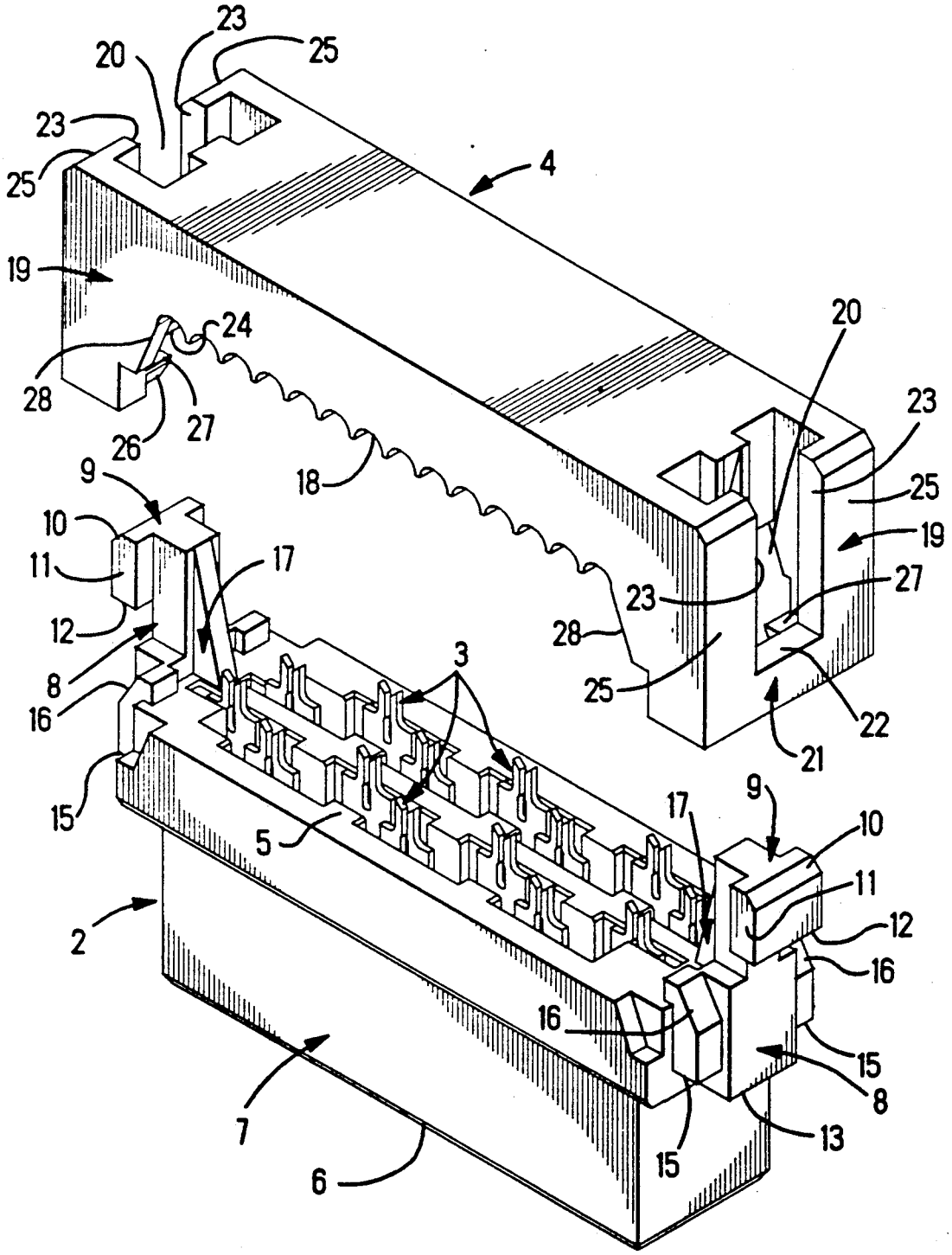
FIG. 1 is an exploded perspective view of a multiple conductor cable connector in accordance with the present invention.

With more particular reference to the drawing, FIG. 1 shows a multiple conductor cable connector 1 exploded to reveal a housing 2, insulation displacement contacts 3, and a termination cover 4.

The housing 2 and termination cover 4 are each made of dielectric insulative material. In a preferred embodiment, the housing 2 is made of a more rigid material, while the termination cover 4 is made of a more flexible material such that the termination cover 4 will deflect more than the housing 2 and towers 8 during assembly of the connector 1.

As can be seen in FIG. 1, the housing 2 includes a cable receiving face 5, a mating face 6 opposite the cable receiving face 5, a lower body 7 from which the mating face 6 extends, and, at each end, a tower 8. Each tower 8 extends substantially perpendicular to the cable receiving face 5, forming at the distal end a bulk section 9 in a T configuration with the tower 8. A top edge of each bulk section 9 is beveled, forming a deflecting ramp 10. The deflecting ramp 10 aids in assembly by deflecting a portion of the termination cover 4 over the bulk section 9. Each bulk section 9 also has side surfaces 11. The side surfaces 11 cooperate with a portion of the termination cover 4 to align the housing 2 and the termination cover 4. A bottom surface of each bulk section 9 forms a latching surface 12. The latching surface 12 cooperates with a portion of the termination cover 4 to secure the termination cover 4 to the housing 2 in a pre-termination position.

The towers 8 project from each end of the housing 2 beyond the lower body 7, rather than from the cable receiving face 5. As such, each tower 8 forms a lower surface 13. A portion of lower surface 13 forms a latching surface 15. While lower surface 13 and latching surface 15 may be at the same elevation, it is not required. In the preferred embodiment, latching surface 15 is between the cable receiving face 5 and the lower surface 13. The latching surface 15 cooperates with a portion of the termination cover 4 to secure the termination cover 4 to the housing 2 in a termination position. In a preferred embodiment, there are two latching surfaces 15, one on each side of the tower 8, and the latching surfaces 15 are closer to the cable receiving face 5 than is the lower surface 13. A top edge of the tower 8 is beveled, forming an engaging ramp 16, which aids in assembly by deflecting a portion of the termination cover 4 over the tower 8. Each tower 8 is reinforced by beams 14 and a strut 17.

Figure 2:
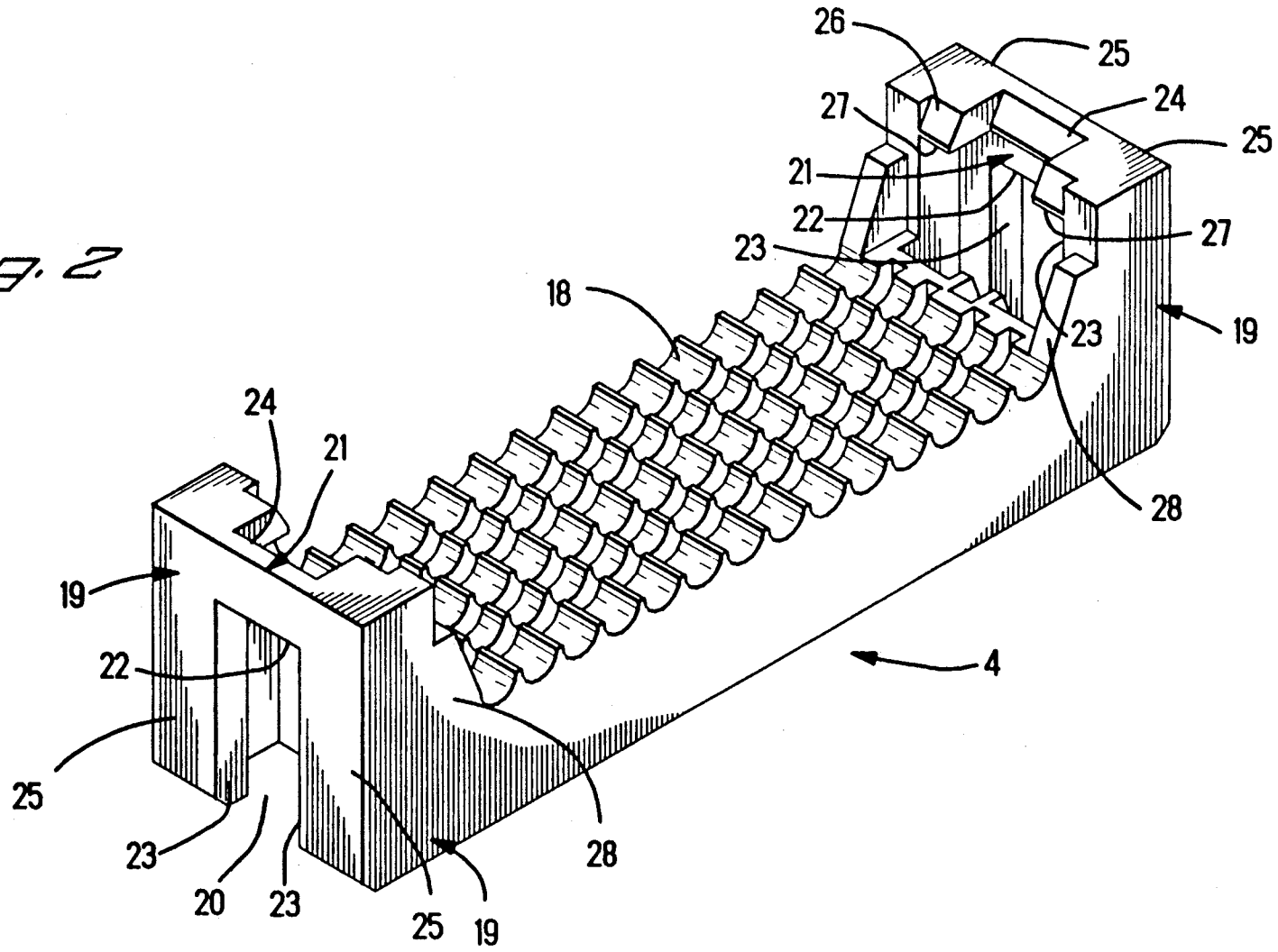
FIG. 2 is a perspective view of a termination cover of the connector shown in FIG. 1.

As can be seen in FIG. 2, the termination cover 4 has a cable engaging face 18 and arms 19 at opposite ends thereof substantially perpendicular to the cable engaging face 18. Each arm 19 has removed from it a recess or slot 20 defining a pair of arm members 25 and a bar 21 bridging the distal ends of the arm members 25. The slot 20 reveals a latching surface 22 on the bar 21 and inner surfaces 23 on the arm members 25. Inner surfaces 23 cooperate with side surfaces 11 of the bulk section 9 to align the tower 8 and the arm 19. The latching surface 22 cooperates with the latching surface 12 of the bulk section 9 to secure the termination cover 4 to the housing 2 in a pre-termination position. A distal edge of the bar 21 of each arm 19 is beveled, forming a deflecting ramp 24. The deflecting ramp 24 aids in assembly by cooperating with the deflecting ramp 10 of the bulk section 9 to deflect the arm 19 and the bar 21 over the bulk section 9.

A bottom, with reference to FIG. 1, edge of each arm member 25 is also beveled, forming an engaging ramp 26. The engaging ramp 26 is biased against the engaging ramp 16 when in the pre-termination position. The engaging ramp 26 aids in assembly by cooperating with the engaging ramp 16 of the tower 8 to deflect the arm 19 and the arm members 25 over the tower 8. An inner surface of the arm 19 defines a latching surface 27. The latching surface 27 cooperates with the latching surface 15 of the tower 8 to secure the termination cover 4 to the housing 2 in a termination position. Each arm 19 includes a cable guide 28 to guide a cable to the cable engaging face 18.

Figure 3:
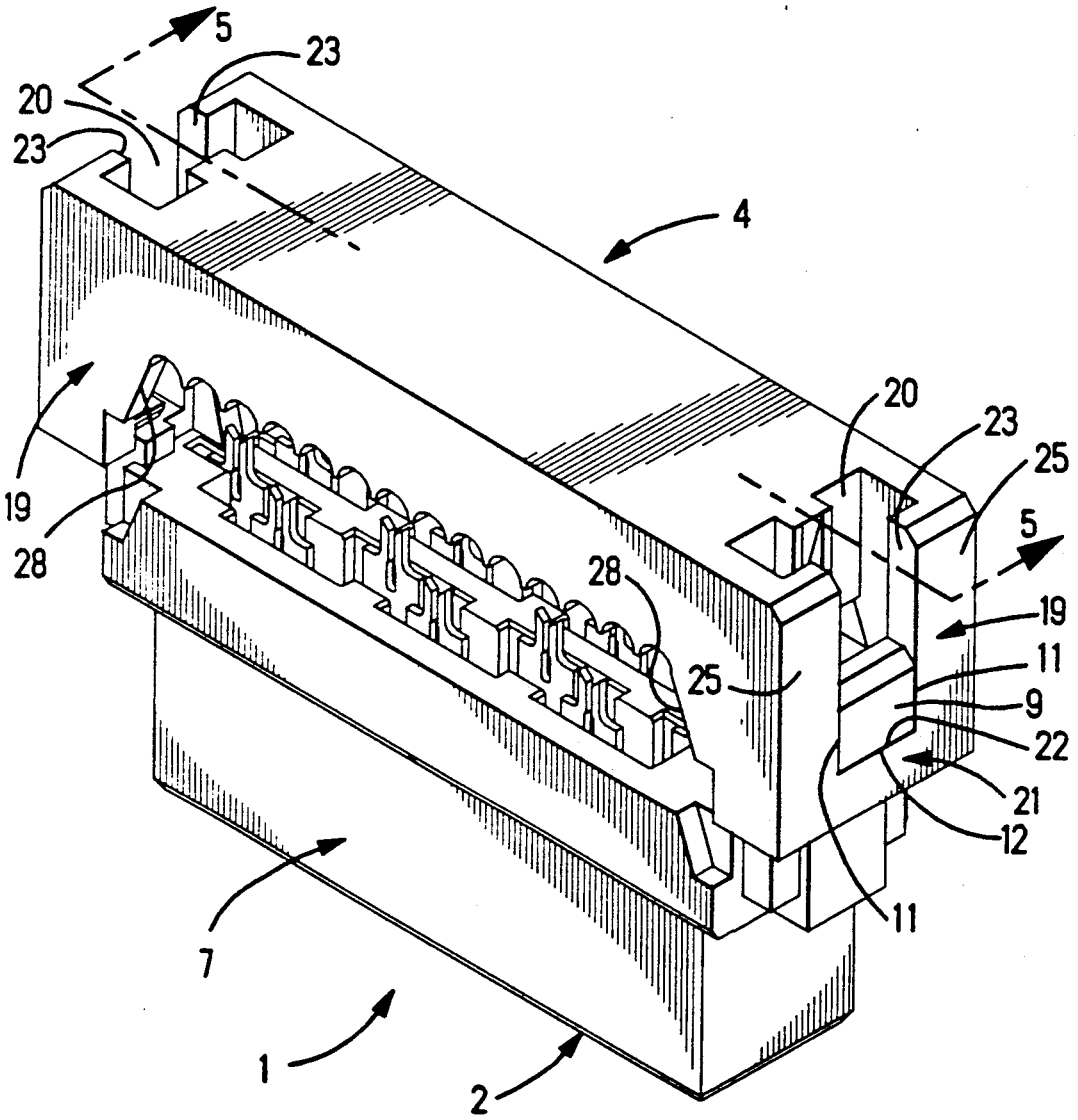
FIG. 3 is a perspective view of the connector shown in FIG. 1 in a pre-termination position.
Figure 4:
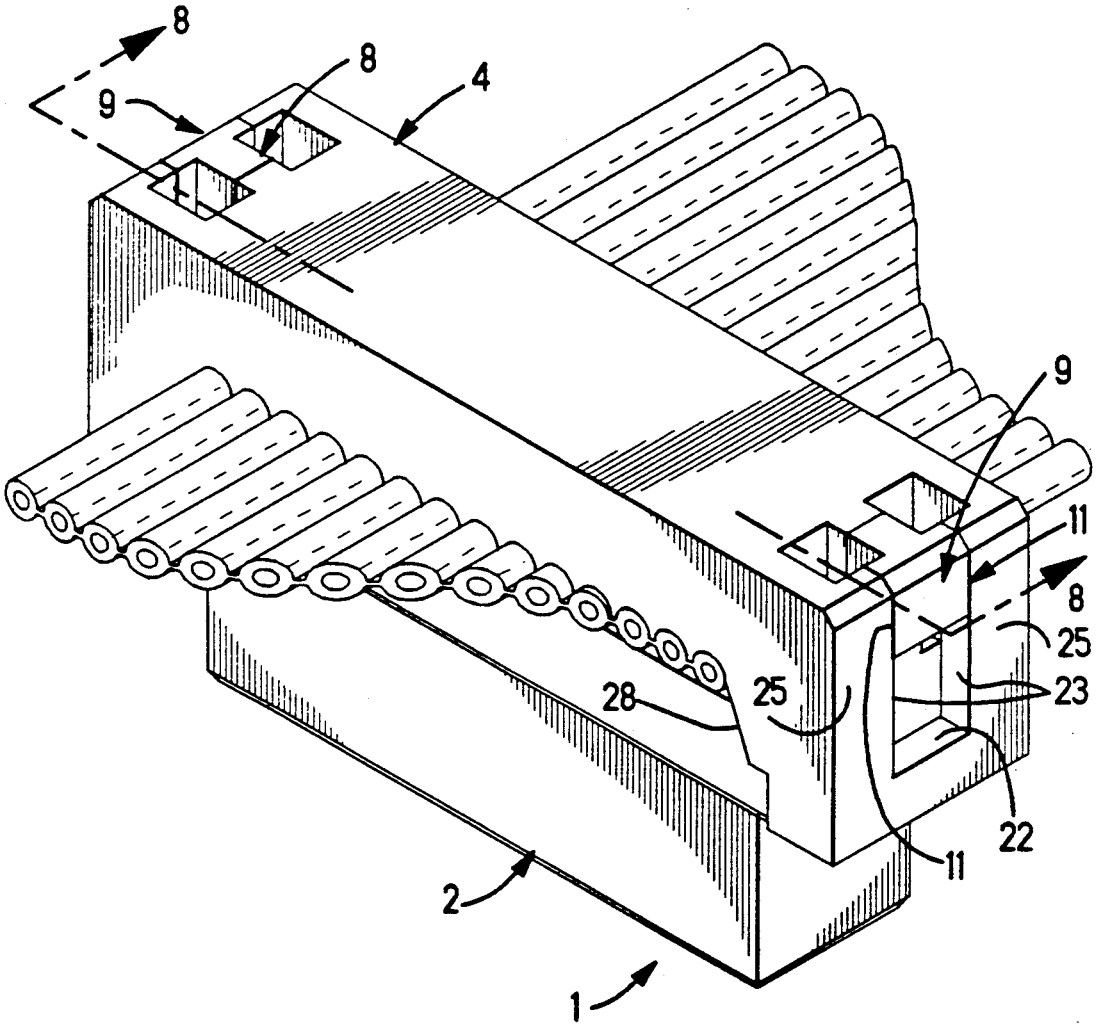
FIG. 4 is a perspective view of the connector shown in FIG. 1 in a termination position, shown with a multiple conductor cable.

As shown in FIG. 3, the connector 1 is secured in a pre-termination position by the latching surface 22 of the recess 20 engaging the latching surface 12 of the bulk section 9 and the engaging ramp 26 of the arm 19 being biased against the engaging ramp 16 of the tower 8. As shown in FIG. 4, the connector 1 is secured in a termination position by the latching surface 27 facing the latching surface 15 to form a stop.

Figure 5:
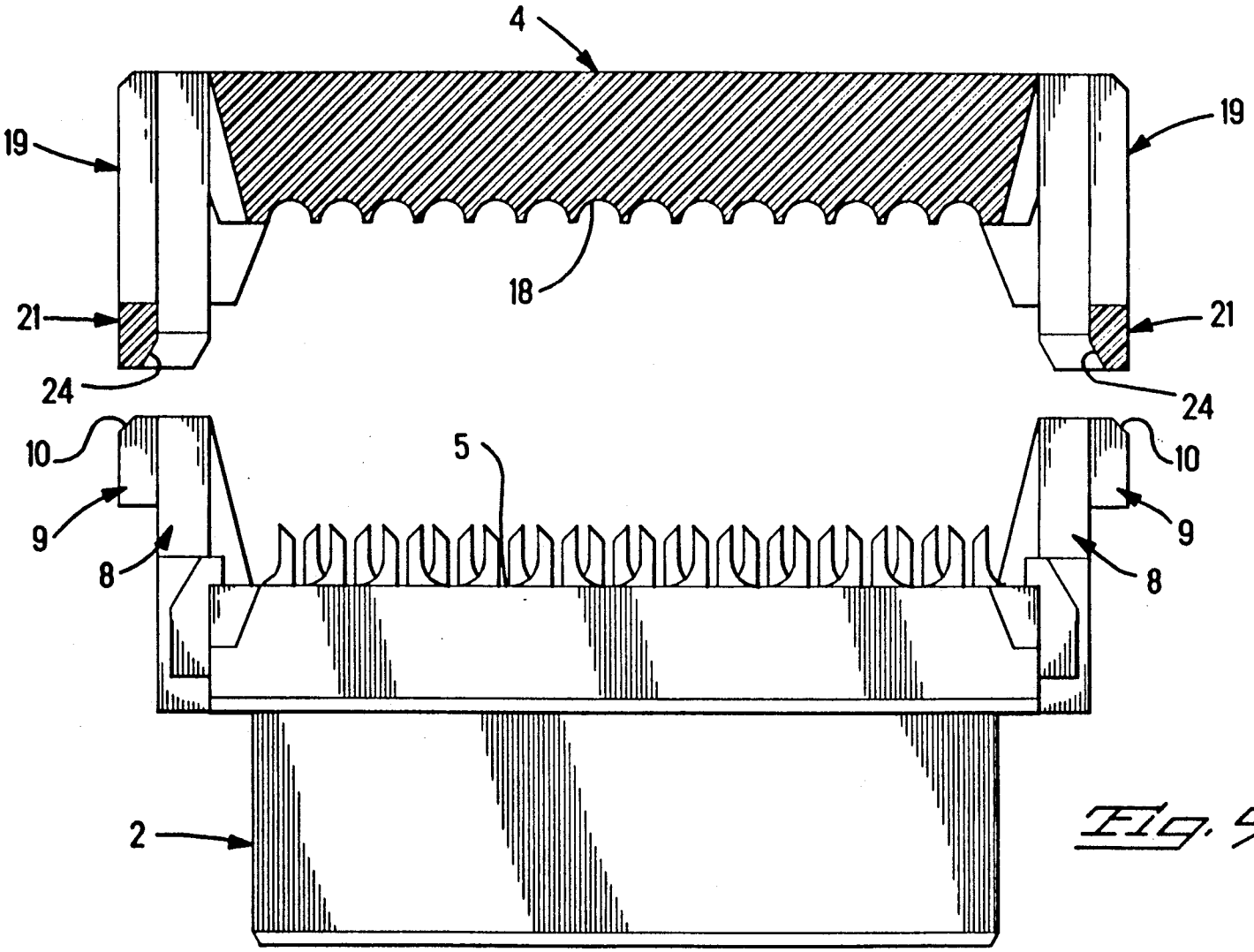
FIG. 5 is a side elevation view in action sequence showing the connector of FIG. 3 with the housing and termination cover, partly in section along line 5—5 of FIG. 3, separate.
Figure 6:
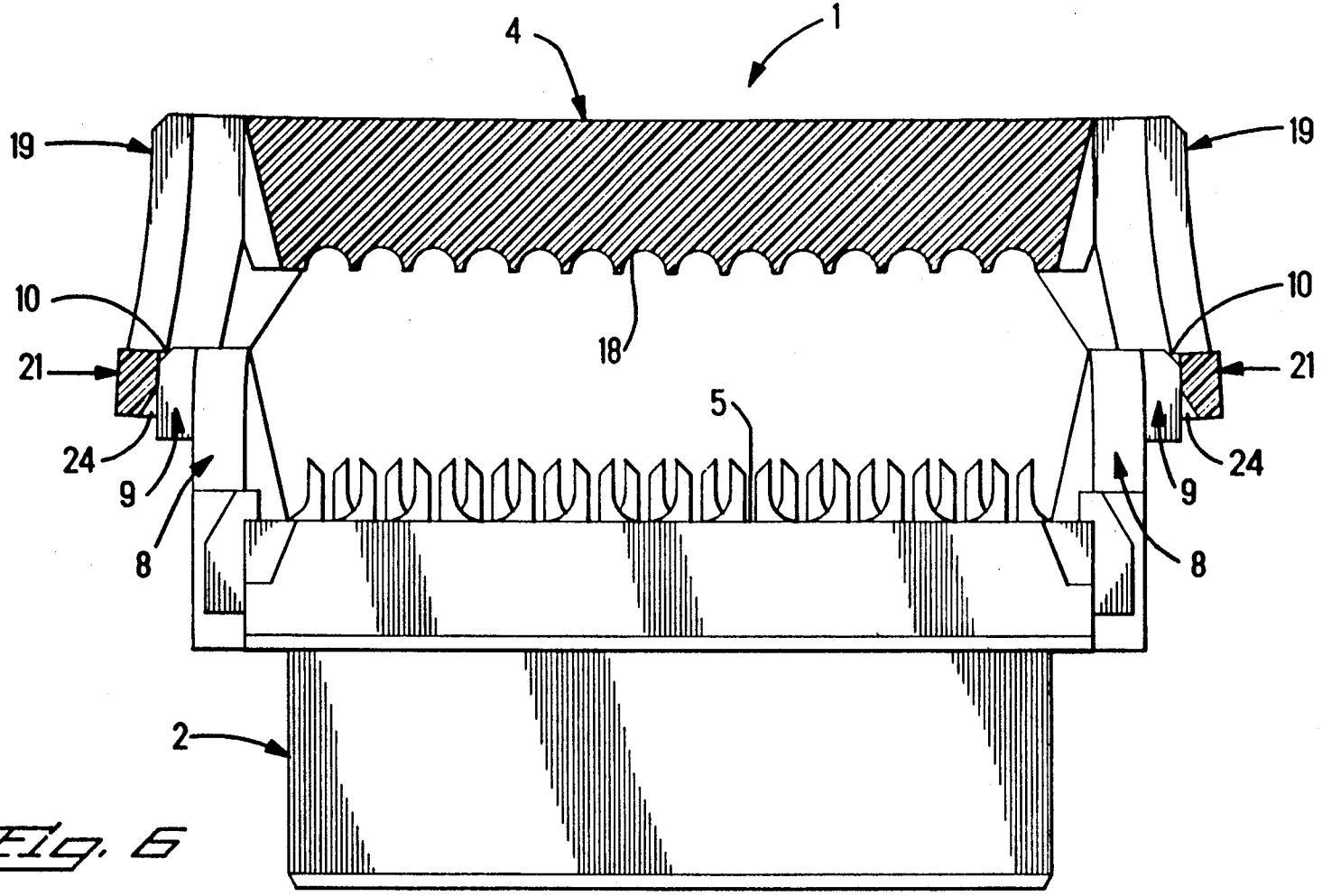
FIG. 6 is a side elevation view in action sequence showing the connector of FIG. 3 with the housing and termination cover, partly in section along line 5—5 of FIG. 3, flexing prior to the termination position.

With reference to FIGS. 5 through 9, the connector 1 is assembled by attaching the termination cover 4 to the housing 2. The cable engaging face 18 of the termination cover 4 faces the cable receiving face 5 of the housing 2, as shown in FIG. 5. The arms 19 are aligned with the towers 8. As the cable engaging face 18 is pressed towards the cable receiving face 5, the deflecting ramp 10 of the bulk section 9 deflects outward the deflecting ramp 24 of the arm 19, as shown in FIG. 6. Being of a more flexible material in the preferred embodiment, the arms 19 of the termination cover 4 are deflected more than the bulk sections 9 and the towers 8 of the housing 2. This deflection permits the arm 19 and the bar 21 to pass over the bulk section 9.

Figure 7:
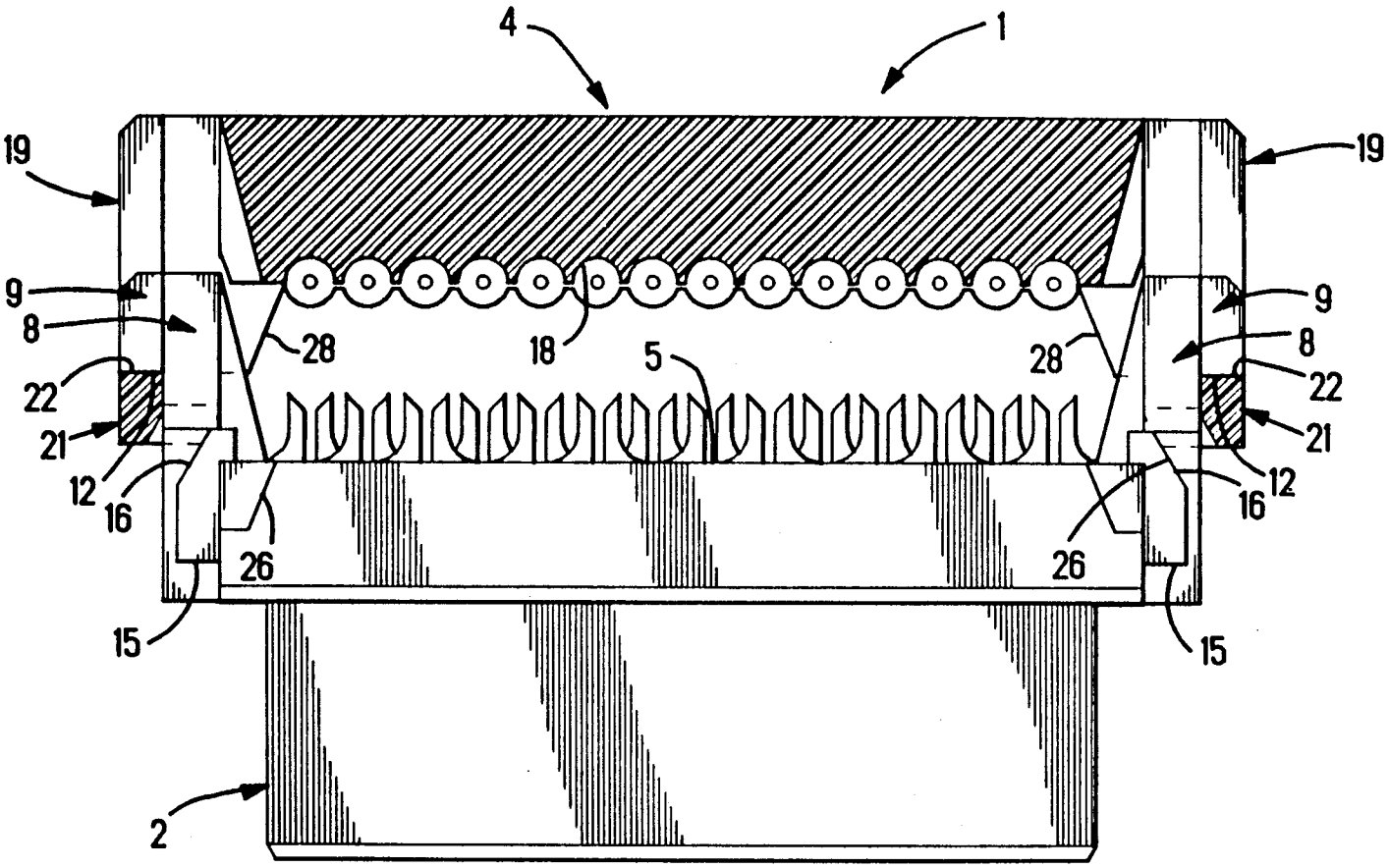
FIG. 7 is a side elevation view in action sequence showing the connector of FIG. 3 with a cable, with the housing and termination cover, partly in section along line 5—5 of FIG. 3, in the pre-termination position.

As shown in FIG. 7, the arms 19 resile back to their original position with the latching surface 22 of the recess 20 biased against the latching surface 12 of the bulk section 9, and the engaging ramp 26 of the arm 19 biased against the engaging ramp 16 of the tower 8. The bulk section 9 is within the slot 20, with the side surfaces 11 of the bulk section 9 articulate the inner surfaces 23 of the arm 19. The connector 1 is thus secured in a pre-termination position.

While multiple conductor cable, not shown in FIGS. 5 and 6, may have been previously placed between the cable receiving face 5 and the cable engaging face 18, it is preferred to thread the cable while in the pre-termination position, as shown in FIG. 7. For sake of clarity of the cooperation of the towers 8 of the housing 2 with the arms 19 of the termination cover 4, the cable is not shown in FIGS. 5 and 6.

Figure 8:
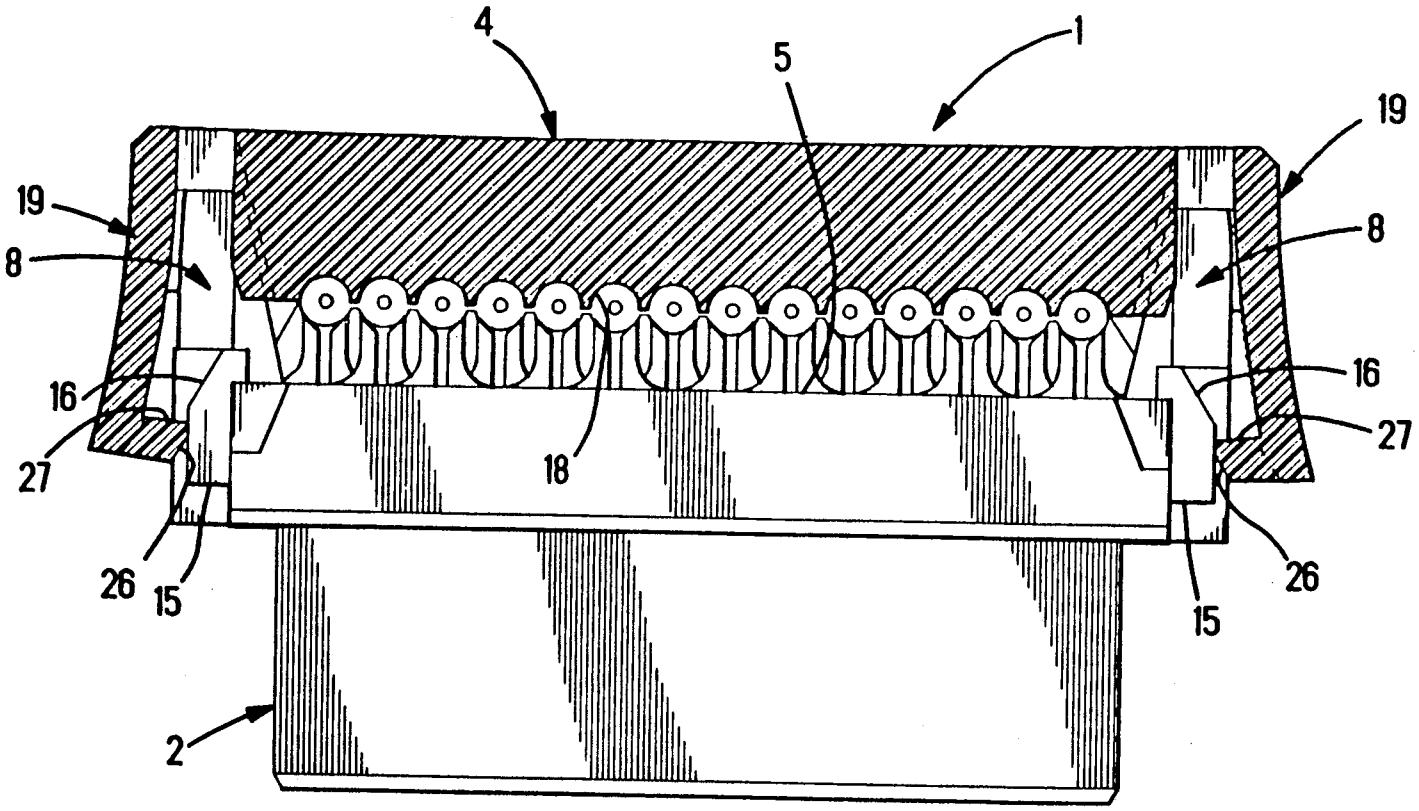
FIG. 8 is a side elevation view in action sequence showing the connector of FIG. 4 with the housing and termination cover, partly in section along line 8—8 of FIG. 4, flexing prior to the termination position.
Figure 9:
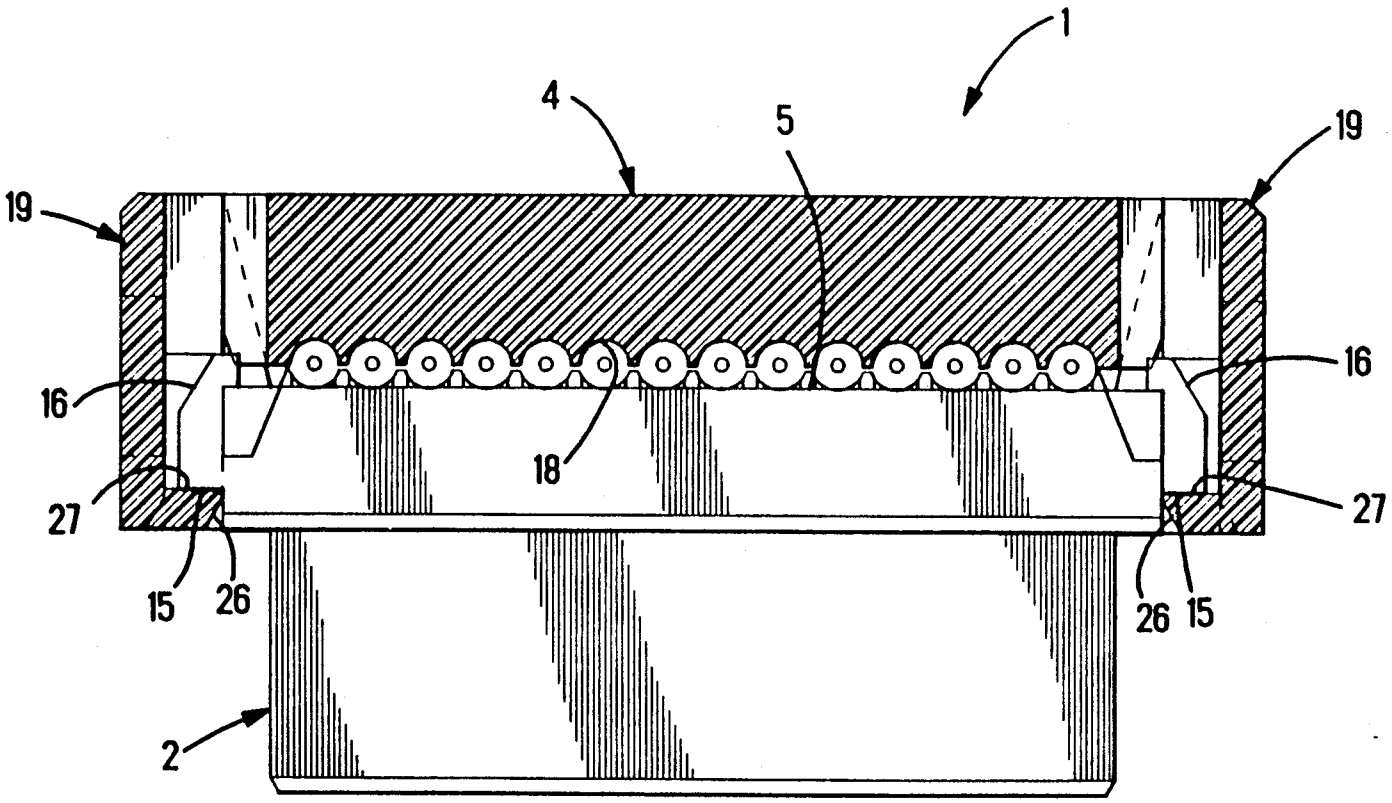
FIG. 9 is a side elevation view in action sequence showing the connector of FIG. 4 with the housing and termination cover, partly in section along line 8—8 of FIG. 4, in the termination position.

As the cable engaging face 18 is pressed closer to the cable receiving face 5, as shown in FIG. 8, the engaging ramps 16 of the towers 8 deflect outward each corresponding engaging ramp 26 of the arms 19. This permits the arms 19 to pass over the towers 8. As shown in FIG. 9, the arms 19 resile back to their original position with the latching surfaces 27 facing corresponding latching surfaces 15 to form a stop. The bulk section 9 is within the slot 20, with the side surfaces 11 of the bulk section 9 articulating the inner surfaces 23 of the arm 19. The connector 1 is thus secured in a termination position. Previously inserted multiple conductor cable would be terminated to the contacts 3 in the termination position.

An advantage of the invention is that the towers 8 and arms 19 define a pre-termination position separate from the termination position. This permits the housing 2 and the termination cover 4 to be manufactured separately and to be assembled into the connector 1 in the pre-termination position. The user is able to insert a multiple conductor cable into the connector 1 and then terminate the assembly.

Use of the towers 8 permits the connector 1 to have a housing 2 with a mating face 6 and lower body 7 of minimum size, by moving all features for securing the housing 2 and the termination cover 4 to opposite ends of the connector 1. The towers 8 also provide the connector 1 with additional strength and stability.

What is claimed is:

1. An electrical connector, comprising:

an elongate dielectric housing having contacts secured therein, said housing defining a conductor receiving face beyond which said contacts have insulation displacing plates for termination to conductors, said connector defining side walls along a major dimension of the conductor receiving face and end walls along a minor dimension of the conductor receiving face, a tower extending from said housing proximate each end wall to beyond said conductor receiving face, each tower centrally located relative to said side walls, each tower having a latch shoulder thereon, said latch shoulder facing a direction opposite said conductor receiving face, said latch shoulder having a portion extending laterally toward a respective side wall beyond respective sides of said tower; and a terminating cover having spaced latch arms extending therefrom, said spaced latch arms having complementary latch shoulders thereon cooperable with said latch shoulders of said housing to secure the terminating cover to the housing, whereby the terminating cover is secured to the housing in a pretermination position.

2. An electrical connector as recited in claim 1, wherein said towers extend from said end walls.

3. An electrical connector as recited in claim 1, wherein said housing further comprises at least one terminating position latch shoulder, said terminating position latch shoulder facing in the same direction as said latch shoulder, said at least one secondary latch shoulder positioned toward said conductor receiving face from said latch shoulder, said terminating cover having at least one complementary terminating latch shoulder cooperable with said at least one terminating position latch shoulder of the housing to secure the terminating cover to the housing in the terminating position.

4. An electrical connector, comprising:

an elongate dielectric housing having contacts secured therein, said housing defining a conductor receiving face beyond which said contacts have insulation displacing plates for termination to conductors, said conductor defining side walls along a major dimension of the conductor receiving face and end walls along a minor dimension of the conductor receiving face, a tower extending from said housing proximate each end wall to beyond said conductor receiving face, each tower centrally located relative to said side walls, each tower having a latch should thereon, said latch shoulder facing a direction opposite said conductor receiving face, a portion of each latch shoulder extending laterally toward a respective side wall beyond respective sides of said tower, at least one secondary latch shoulder, said secondary latch shoulder facing in the same direction as said latch shoulder, said at least one secondary latch shoulder positioned toward said conductor receiving face from said latch shoulder, said terminating cover having at least one complementary terminating position latch shoulder cooperable with said at least one secondary latch shoulder of the housing; and a terminating cover, said terminating cover having spaced latch arms extending therefrom to respective distal ends, each of said spaced latch arms having first and second latch means proximate said distal end, the terminating cover capable of being secured to the housing in first and second positions, in said first position the first latch means on each latch arm engages a respective said latch shoulder with the terminating cover spaced from the conductor receiving face to permit insertion and alignment of conductors therebetween for termination, the termination cover movable from the first position toward the conductor receiving face to a second position, the terminating cover secured to the housing at the second position with the second latch means engaging a complementary terminating latch shoulder.

5. An electrical connector as recited in claim 4, wherein said towers extend from said end walls.

* * * * *